US007784710B2

(12) United States Patent
Thomson

(10) Patent No.: US 7,784,710 B2
(45) Date of Patent: Aug. 31, 2010

(54) DELIVERY SYSTEM FOR A MEDICAMENT OR WELL-BEING ENHANCING COMPOSITION

(76) Inventor: Ian Robert Thomson, 41 Marchioness Way, St. Neots (GB) PE19 8DL ( * ) Notice: Subject to any disclaimer, the term of this patent is extended or adjusted under 35 U.S.C. 154(b) by 34 days.

(21) Appl. No.: 12/260,714

(22) Filed: Oct. 29, 2008

(65) Prior Publication Data

US 2009/0053274 A1 Feb. 26, 2009

Related U.S. Application Data

(63) Continuation of application No. 10/517,187, filed as application No. PCT/GB03/02443 on Jun. 6, 2003.

(30) Foreign Application Priority Data

Jun. 8, 2002 (GB) ..... 0213245.4
Sep. 2, 2002 (GB) ..... 0220276.0

(51) Int. Cl.
*A24F 25/00* (2006.01)

(52) U.S. Cl. ..... 239/36

(58) Field of Classification Search ..... 239/34, 239/36, 41–43, 55, 56
See application file for complete search history.

(56) References Cited

U.S. PATENT DOCUMENTS

| | | | | |
|---|---|---|---|---|
| 3,725,960 | A | 4/1973 | Hall | |
| 4,161,283 | A | 7/1979 | Hyman | |
| 4,283,011 | A * | 8/1981 | Spector | 239/36 |
| 4,465,232 | A | 8/1984 | Field | |
| 4,744,514 | A | 5/1988 | Gadoua | |
| 4,848,929 | A | 7/1989 | Rawl | |
| 5,738,831 | A * | 4/1998 | Bethel | 422/120 |
| 6,126,085 | A | 10/2000 | Wanzenbock | |
| 6,156,323 | A | 12/2000 | Verdicchio et al. | |
| 6,250,829 | B1 | 6/2001 | Brower et al. | |
| 2004/0156928 | A1 | 8/2004 | Cordes et al. | |

FOREIGN PATENT DOCUMENTS

| | | |
|---|---|---|
| DE | 26 49 877 A1 | 5/1978 |
| DE | 28 41 365 A1 | 4/1980 |
| DE | 32 16 609 A1 | 11/1983 |
| DE | 299 18 743 U1 | 5/2000 |
| EP | 0 220 388 A2 | 7/1986 |

(Continued)

OTHER PUBLICATIONS

International Search Report completed on Nov. 24, 2003 and issued to a related foreign application.

*Primary Examiner*—Davis Hwu
(74) *Attorney, Agent, or Firm*—Knobbe, Martens, Olson & Bear LLP

(57) ABSTRACT

A delivery system for a medicament or well-being enhancing composition, comprising a flexible member, means for attaching the flexible member to fabric to form a pocket and an absorbent pad for impregnation with the medicament or well-being enhancing composition arranged such that when the flexible member is attached to a piece of fabric a pocket is formed shaped and sized such the pad may be received and held securely within the pocket but is removable therefrom. The fabric is typically part of a garment or bed-linen.

9 Claims, 3 Drawing Sheets

FOREIGN PATENT DOCUMENTS

| | | |
|---|---|---|
| FR | 2 605 215 | 4/1988 |
| GB | 2 276 321 | 9/1994 |
| JP | 05097663 A | 4/1993 |
| JP | 08-119805 | 5/1998 |
| JP | 11-000297 | 1/1999 |
| JP | 2002-143203 | 5/2002 |
| WO | WO 94/19043 | 9/1994 |
| WO | WO 97/03658 | 2/1997 |
| WO | WO 02/49623 | 6/2002 |
| WO | WO 03/000162 | 1/2003 |

* cited by examiner

DELIVERY SYSTEM FOR A MEDICAMENT OR WELL-BEING ENHANCING COMPOSITION

RELATED APPLICATIONS

This application is a continuation of U.S. application Ser. No. 10/517,187, filed May 31, 2005, which is the U.S. National Phase under 35 U.S.C. §371 of International Application No. PCT/GB03/02443, filed Jun. 6, 2003, which claims priority to GB Application No. 0213245.4, filed Jun. 8, 2002, and GB Application No. 0220276.0, filed Sep. 2, 2002, the contents of which are incorporated herein by reference in their entireties.

FIELD OF THE INVENTION

The present invention relates to a delivery system for delivering a medicament or well-being enhancing composition. The delivery system is adapted for ready attachment to fabric, typically a garment or bed-linen. The invention is applicable with particular advantage to garments adapted for the delivery of inhalable medicaments including sports clothing, and in particular for clothing for children.

There are many different oils and creams available which are impregnated with a vaporizing decongestant. Such creams and oils are intended for use on the skin such that the heat of the skin heats up the decongestant to slowly release decongesting vapor which can be inhaled to keep the nasal passages clear.

Such oils and creams can in some cases irritate the skin especially the delicate skin of children. Parents often rub such creams into the clothing of the child or impregnate a handkerchief with a decongestant oil. The amount of decongestant is not controlled and it can also ruin the clothes by staining them. In such cases the decongestant can also come into contact with the skin causing the same irritation.

Even professional sportsmen sometimes rub a slow release vaporizing decongestant into their shirt. They have found that this can help to keep their head and nasal passages clear while indulging in their sporting activity, especially in cold weather.

A number of devices and systems for the delivery of such decongestants have been disclosed and are currently available. One such product comprises a self-adhesive plaster for attachment to the skin which is impregnated with a volatile decongestant. This can cause problems for those with sensitive skins or allergies and can be a particular problem for babies.

Other products comprise impregnated adhesive patches for adhering to a garment. However, the patches tend to peel off and have a short life on any garment, limited at least by each wash cycle.

In this specification the term medicament will be taken to encompass any material which has a curative or alleviating effect. A well-being enhancing composition is one which tends to promote the health and feelings of health and well-being and encompasses perfumes and essential oils, insect repellants and muscle relaxants.

SUMMARY OF THE INVENTION

According to the invention there is provided a delivery system for a medicament or well-being enhancing composition, comprising a flexible member, means for attaching the flexible member to fabric to form a pocket and an absorbent pad for impregnation with the medicament or well-being enhancing composition arranged such that when the flexible member is attached to a piece of fabric a pocket is formed shaped and sized such the pad may be received and held securely within the pocket but is removable therefrom.

In order for the medicament or well-being enhancing composition to be delivered to a user, the fabric clearly is one which will be in close proximity to the user—typically and preferably the fabric is part of a garment or of bed-linen.

Typically the garment may be a shirt, sporting top or pajama top or, in the case of a baby or small child, an all-in-one suit. Alternatively the garment may be a glove. The delivery system may be attached to the palm of the glove.

Where the fabric comprises bed-linen, typically the delivery system is attached to a pillowcase, especially where the medicament is a volatile, inhaled medicine or decongestant.

The flexible member may comprise a single layer of material which will form a pocket when attached to the fabric. Alternatively the flexible member comprises a pouch into which the pad may be slipped and readily removed. Preferably the flexible member is of a light permeable material allowing the heat of a body to pass from outside the pocket to the absorbent pad and for vapor to be released by the pad or for the medicament impregnated on the pad to pass through the fabric. Alternatively the material may be chosen such that the medicament cannot pass through the material to the skin—but an inhalable vapor will be released through the material.

Preferably the flexible member is of a net or mesh material which will hold the pad securely but allow the skin to be in contact with the pad. In the event that a decongestant use may irritate the skin of the wearer a light cotton material may be preferred. The flexible member may be a woven or non-woven material. A preferred material is a cotton muslin. The choice of other suitable materials will depend upon the particular medicament or well-being enhancing composition to be delivered the choice of which will be readily apparent to the skilled addressee of the specification.

The means for attaching the flexible member to the fabric is preferably arranged to provide a quick and easy means to secure the pocket in position and may comprise a release adhesive. However preferably the means of attachment comprises a material, typically non-woven impregnated with a heat activated adhesive which thus is an 'iron-on composition' such as that sold under the trade mark WUNDAWEB.

In the case of a single layer of material forming the flexible member, the attachment means is arranged around the periphery of the flexible member with an opening to allow the pad to be introduced into the pocket. In the case of a pouch being mounted upon the fabric the positioning of the means for attachment does not have to define a pocket merely to securely attach the pouch in position. The material may comprise one face of the pouch or purely be mounted along the peripheral edges. Where an iron-on surface such as WUNDAWEB is used it can be positioned on a garment as required by the user and then secured in position by ironing and activating the adhesive in the iron-on surface. The pocket thus mounted will be held securely in position for at least five washes allowing replacement of the pad as required.

The pocket formed by the flexible member and the fabric to which it is in use attached, may be an open-topped pocket. Provided that the pad size is only just smaller than the pocket once in position if the fabric is part of a garment, when the garment is worn it will be held securely. However the retention of the absorbent pad within the pocket if it is open topped when the pocket is mounted upon a pillowcase could be difficult.

The pocket may have a closure to prevent the pad from falling out when the garment is worn, in particular during active sports. This is particularly preferable when the flexible member itself comprises a pouch. Preferably such closure may comprise a pad engaging flap at the open entrance to the pocket, the flap being folded back on itself to form an end pocket which is slipped over the outer edge of the absorbent pad to retain it in position. Such arrangement is similar to a pillowcase.

Preferably the absorbent pad is of a shape and size to ensure that it is not heavy for the weight of the fabric to which the delivery system is to be mounted and that it is not obtrusive. Conveniently the pad may be in a square or rectangular pillow shape with sides between 2 cm and 16 cm and depth between ¼ cm to 1 cm.

The pad may be a foam pad or cotton—or may comprise an impregnated non woven sheet of fabric (which may be folded to form a pad or inserted in the pocket as a sheet—dependent upon the intended use)

Since the pocket may be attached to a garment inside the garment where it is unobtrusive or outside the garment when it will be seen, the choice of color and design of the flexible member will vary dependent upon its intended use. For example, a pocket for use on a sport shirt may be mounted at the front of the shirt, in which case, the flexible member may conveniently be printed with advertising material. On other occasions the flexible member will be of a material which will match the color of the fabric to which it is to be attached.

The delivery system is preferably sold as a kit of parts comprising one flexible member with the means of attachment to the fabric secured or part of the flexible member, together with a number of absorbent pads, typically five impregnated with the required medicament or well-being enhancing composition. Preferably the pads are supplied individually securely wrapped. The advantage of a pre-impregnated pad is that the correct dosage and concentration are used.

Alternatively the pads may be supplied unimpregnated with a supply of the composition to be added to the pad before insertion into the pocket. This is useful if different strengths and dosages need to be used for different people—for example for children of different ages.

The medicament may be any material which has a curative or alleviating effect, which has to be brought into close proximity to the user to have its effect. It is typically a volatile or percutaneously administered drug.

In one preferred embodiment the medicament is volatile and inhalable, such as a vaporized decongestant. In such cases the pocket would be positioned such as to locate the pad in a position such that vaporized decongestant may readily be inhaled by the wearer.

The advantage of this system is that the decongestant can be impregnated into the pad at exactly the correct concentration to deliver a recommended dose to the wearer. The pad may be readily removed from the holder for washing of the garment and for replacing after a predetermined time.

The choice of suitable vaporizing decongestant will be apparent to the skilled addressee of the specification as will be the choice of appropriate material for the pad for receiving the decongestant. Typically a suitable material for the pad will be dependent on the decongestant formulation chosen.

Suitable percutaneously administered medicaments include pain relief drugs and antihistamine creams.

Typical well-being enhancing compositions include creams, ointments and lotions for cuts and abrasions, antiseptics, insect sting and bite creams and insect repellants, all of which may be difficult to administer, especially to a child, or to anyone who suffers allergic reactions to standard medical dressings. Also encompassed are fragrances and essential oils which enhance the feelings of well-being to the user. The pad may also be impregnated with compositions which on exposure to air generate heat or cold—the temperature generated in the composition will transfer the heat or cold for pain relief to the user without the skin of the user coming into contact with the composition.

Where the medicament or well-being enhancing composition would have a localized effect, in use the pocket would be positioned in a region in close contact with an area of the wearer requiring attention.

Although the invention is applicable with particular advantage to sports garments such as football shirts, the invention may also be applied with advantage to children's night clothes—even baby clothes. There is a perennial problem of how to clear the nasal passages of a baby or young child and measures which will prevent the build up of mucous in their nose during the night hours.

In one embodiment of the invention, the pocket may be in the form of a bag having an iron-on surface which can be positioned on a garment as required by the user and then secured in position by ironing and activating the adhesive in the iron-on surface.

It will be appreciated by the skilled addressee of the specification that although the pocket may conveniently be square or rectangular it may be shaped according to the intended usage and medicament which needs to be delivered.

BRIEF DESCRIPTION OF THE DRAWINGS

Examples of delivery systems and garments having such delivery systems attached thereto will now be described, by way of example only, with reference to the accompanying drawings, in which.

DESCRIPTION OF THE PREFERRED EMBODIMENT

Figure 1:
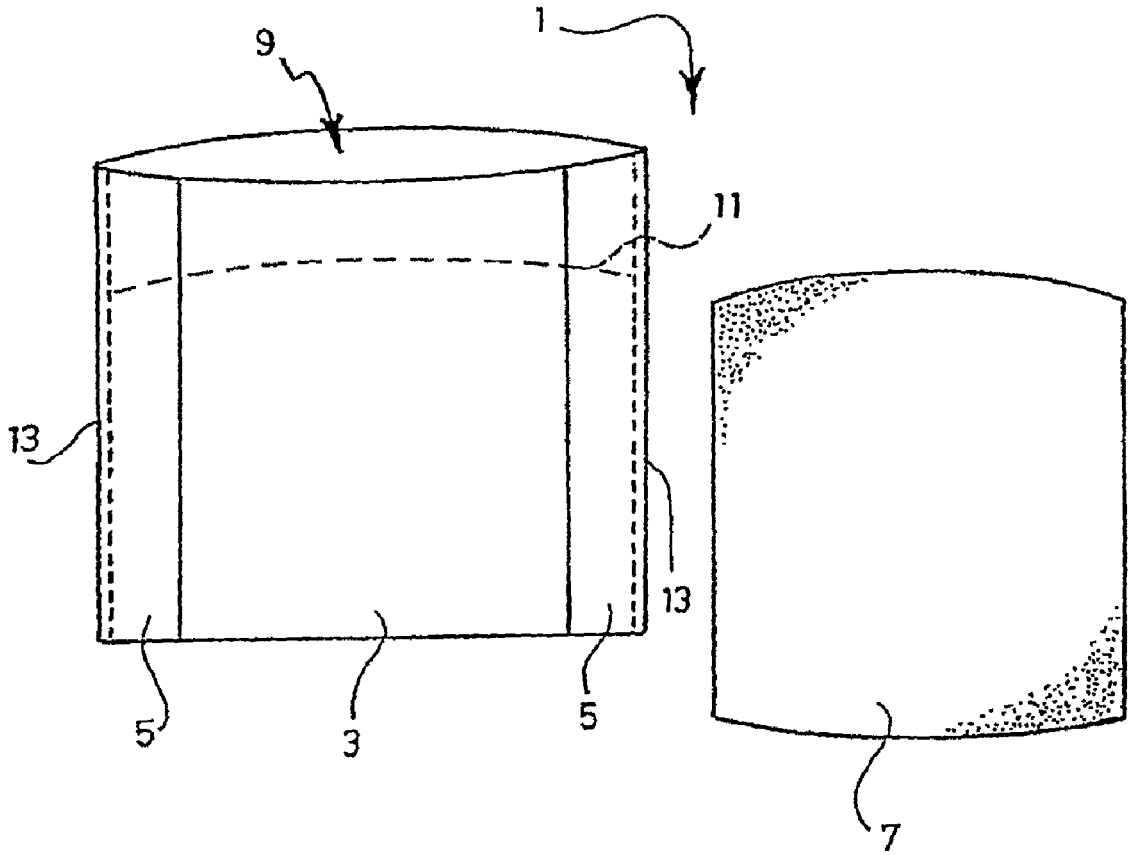
FIG. 1 is a perspective view of a first delivery system.

A first delivery system 1 for a medicament or well-being enhancing composition comprises a flexible member 3, means 5 for attaching the flexible member to fabric to form a pocket and an absorbent pad 7 for impregnation with the medicament or well-being enhancing composition. They are arranged such that when the flexible member 3 is attached to a piece of fabric, a pocket is formed, shaped and sized such that the pad 7 may be received and held securely within the pocket but is removable therefrom.

In this case the flexible member 3 is in the form of a pouch of light cotton muslin. The pouch 3 is substantially rectangular with an open end 9, and a closure flap 11. The closure flap 11 engages the outer end of the pad 7 when it is in position in the pouch in the same way as a pillowcase retains a pillow.

The pouch has been formed from one single length of fabric, sewn only along two parallel seams 13. The parallel seams attach the faces of the pouch together, retain the edges of the flap 11 to form a closure and attach a strip of WUNDAWEB 5 to each edge. The strips 5 are of a non-woven material impregnated with heat activated adhesive.

In use, the user decides on the correct location of the delivery of the composition which will depend on the composition with which the pad is impregnated. If a volatile inhaled composition, the pocket is required at a location on a garment or on a pillowcase where the vapor will be inhaled. Once the desired location of the pad has been finalized, the flexible member is placed in the desired position on the fabric and a hot iron is applied. The adhesive within the strips 5 is activated to attach the pocket into place for securely receiving the pad 7.

Figure 2:
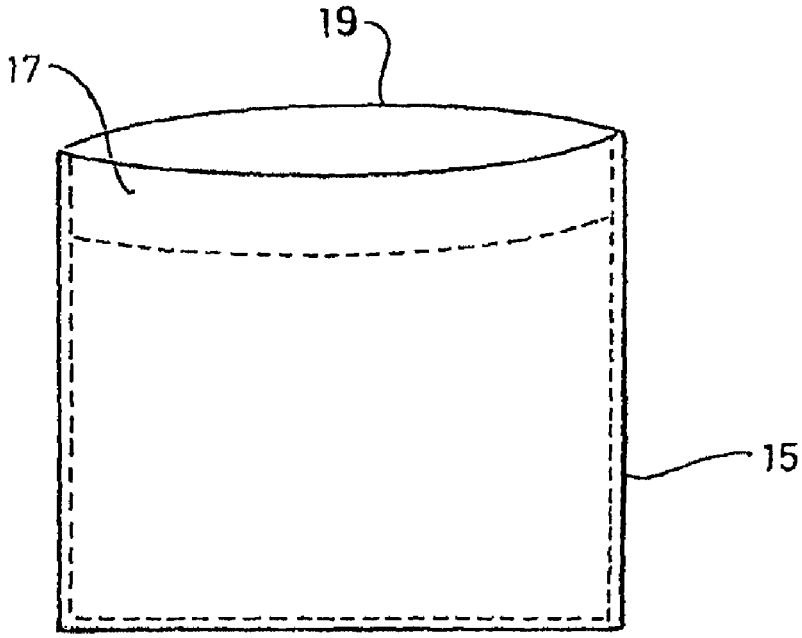
FIG. 2 is a schematic view of a second example of a flexible member for use in a delivery system.

A variation of the flexible member is illustrated in FIG. 2. This flexible member 15 comprises a pouch made of two squares of material sewn together at three sides. One face of the pouch 17 is of a non-woven material impregnated with heat activated adhesive and the other face 19 is of fine cotton muslin. Here the entire face of the pocket will be secured to fabric onto which the pouch is ironed.

Figure 3:
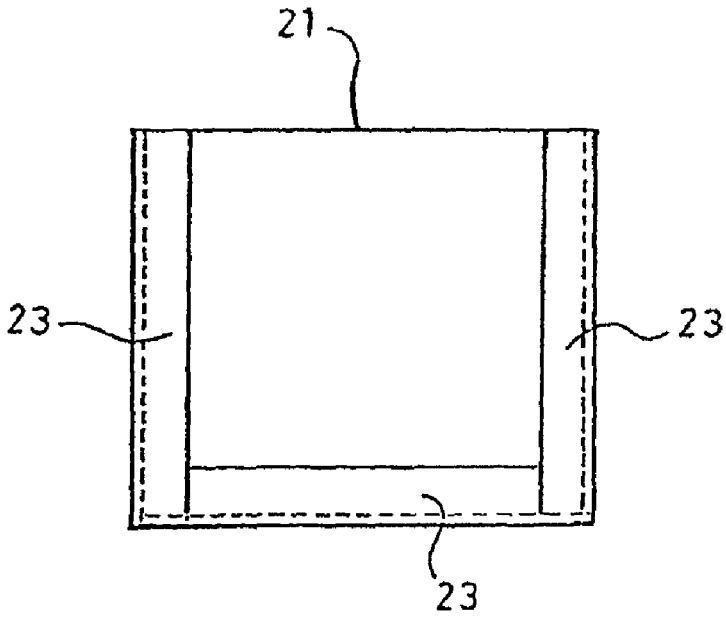
FIG. 3 is a schematic view of a third example of a flexible member for use in a delivery system.

A further variation of a flexible member is illustrated in FIG. 3. This comprises a sheet 21 of cotton muslin, including strips of WUNDAWEB 23 along three of its peripheral edges. The flexible member 21 will form a pocket when it is attached to the fabric.

Figure 4:
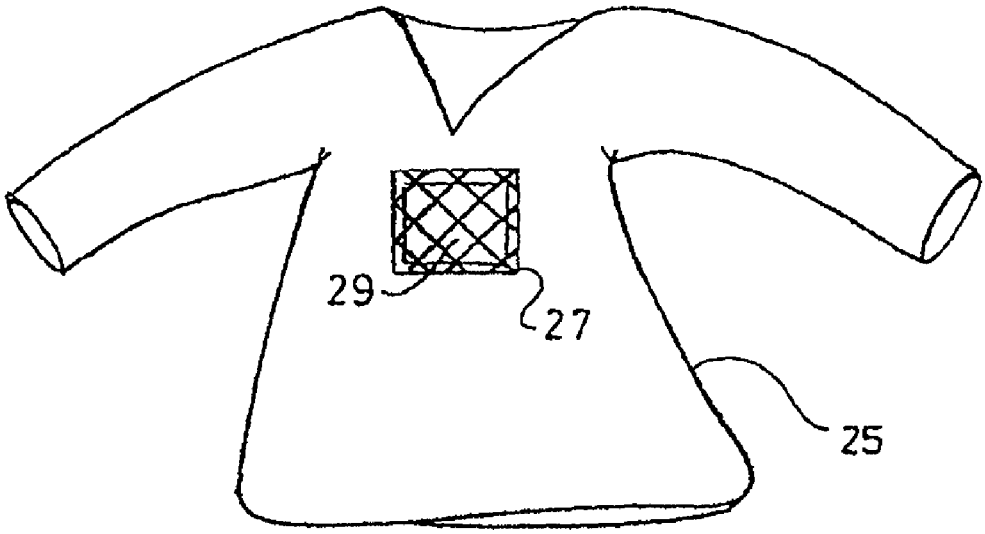
FIG. 4 is a schematic view of a fourth delivery system mounted upon a sports shirt; and, FIG. 5 is a schematic view of a fifth delivery system mounted upon a fingerless glove.

FIG. 4 illustrates a garment 25 which includes a pocket 27 for receiving and holding securely a vaporizing decongestant impregnated pad 29, the pocket 27 positioned such as to locate the pad 29 in a position such that vaporized decongestant may readily be inhaled by the wearer of the garment.

In this case the garment is a sports shirt with the pocket 27 positioned at the centre of the front of the garment just below the neckline to ensure that the vaporized decongestant can readily be inhaled by the wearer of the garment.

In this case the pocket 27 has been formed by a net pouch which has been ironed on to the sports shirt attached by a heat activated adhesive (not shown). The pocket 27 is in this case in the form of an open-topped pocket 27 of net material. The dimensions of the pocket are 12.5 cm by 15.5 cm and the dimensions of the pad are 7.5 cm by 10 cm.

The kit of parts supplied to the purchaser is a pouch 27, with its adhesive strips already attached to the edges of the pocket, together with five impregnated pads 29 sealed in sachets. The pocket 27 will stay in place for at least five washes allowing the pads 29 to be changed as required.

Figure 5:
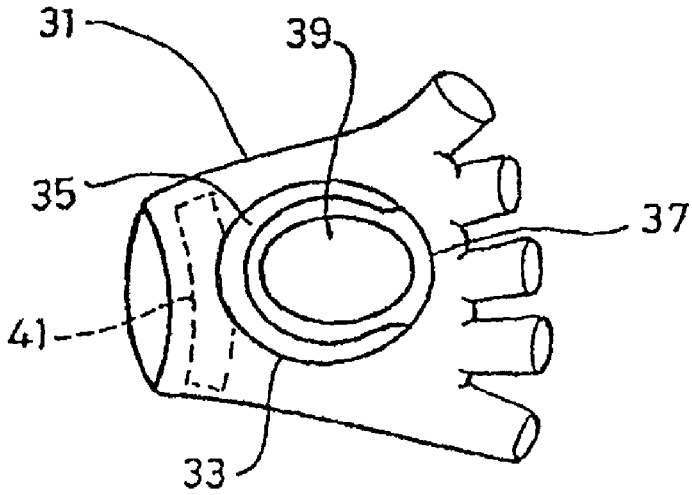

FIG. 5 illustrates an alternative garment 31 to which a delivery system may be attached. In this case the flexible member 33 comprises a substantially circular sheet of material having upon it a peripheral arc 35 of release adhesive which is used to secure the flexible member 33 to the palm of a fingerless glove 31 to form a pocket having an open top 37. Into the pocket may be inserted a disc like pad 39, typically impregnated with a decongestant. Because the glove will be tight on the hand the pad 39 will be held securely within the pocket. The release adhesive 35 is here suitable for use since the glove will not be washed as frequently as for example, a sports shirt. The glove also includes on its opposite face sweatband 41.

What is claimed is:

1. A medicament-releasing bed linen comprising an adsorbent pad impregnated with a medicament and a pocket for carrying the absorbent pad, wherein said pocket is attached to the bed linen and has an opening for receiving the absorbent pad, and is formed, shaped and sized such that the absorbent pad is held securely within the pocket but is removable therefrom via the opening, and a closure member for retaining the absorbent pad within the pocket, wherein the pocket comprises a single piece construction from a flexible member folded over itself to define first and second layers, said first and second layers being attached to each other along part of their peripheries and unattached along other parts of their peripheries, said unattached parts providing the opening for receiving and removing the absorbent member, wherein the first layer includes an extended part that extends beyond the second layer adjacent the opening, and wherein the first layer is folded such that the extended part and the second layer overlap, wherein the extended part of the first layer includes first and second side edges and a transverse edge and is fixed to the pocket along its side edges, and is unattached along its transverse edge, whereby the extended part of the first layer provides a closure member for retaining the absorbent pad within the pocket, and wherein the flexible member comprises a material that enables an inhalable vapor to be released therethrough, such that a person in contact with said bed linen inhales said inhalable vapor.

2. The medicament-releasing bed linen according to claim 1, wherein the medicament includes a vaporized decongestant and/or a muscle relaxant.

3. The medicament-releasing bed linen according to claim 1, wherein the pocket comprises a material that is arranged to prevent the medicament from passing through its structure to the skin but enables an inhalable vapor to be released there through.

4. The medicament-releasing bed linen according to claim 1, wherein the closure member is attached to the pocket at side peripheral portions.

5. The medicament-releasing bed linen according to claim 1, wherein the extended part of the first layer is folded such that it lies between the non-extended part of the first layer and the second layer.

6. The medicament-releasing bed linen according to claim 1, wherein the absorbent member is sold separately from the pocket.

7. The medicament-releasing bed linen according to claim 1, wherein the bed linen is a pillowcase.

8. A method of delivering a medicament to an individual, comprising:

placing said individual in contact with the bed linen according to claim 1, placing said absorbent pad impregnated with said medicament in the pocket;

administering said medicament to the individual by the individual inhaling said inhalable vapor.

9. The method according to claim 8, wherein the bed linen is a pillowcase.

* * * * *